US007108555B2

(12) United States Patent
Mao et al.

(10) Patent No.: US 7,108,555 B2
(45) Date of Patent: Sep. 19, 2006

(54) ELECTRICAL CONNECTOR WITH STEADY SHELL

(75) Inventors: Yu-Hua Mao, Kunsan (CN); Chun-Sheng Li, Kunsan (CN); Feng Zhu, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/105,037

(22) Filed: Apr. 12, 2005

(65) Prior Publication Data

US 2006/0014432 A1 Jan. 19, 2006

(30) Foreign Application Priority Data

Jul. 15, 2004 (CN) ..... 2004 2 0062696

(51) Int. Cl.
*H01R 13/648* (2006.01)

(52) U.S. Cl. ..... 439/607

(58) Field of Classification Search ..... 439/567, 439/607, 680, 378
See application file for complete search history.

(56) References Cited

U.S. PATENT DOCUMENTS

| | | | | |
|---|---|---|---|---|
| 5,147,220 | A * | 9/1992 | Lybrand | 439/567 |
| 5,219,294 | A | 6/1993 | Marsh et al. | |
| 5,401,189 | A | 3/1995 | Sato | |
| 6,305,953 | B1 * | 10/2001 | Shi et al. | 439/607 |
| 6,634,894 | B1 * | 10/2003 | Ko | 439/607 |

* cited by examiner

*Primary Examiner*—Briggitte R. Hammond
(74) *Attorney, Agent, or Firm*—Wei Te Chung

(57) ABSTRACT

An electrical connector includes an insulative housing having base section and a mating port forwardly projecting from the base section, a number of terminals loaded in the insulative housing and each having a contact section disposed in the mating port and a shell provided with a frame section surrounding the mating port and a plate section attached to the base section. The plate section is formed with a pair of ears at opposite longitudinal ends of the base section. The electrical connector further includes a pair of locking blocks disposed at opposite longitudinal ends of the base section. Each locking block is formed with a mounting section rooted onto the base section and a forwardly extending hook beside the mating port. The ears of the plate section are securely sandwiched between the mounting sections of the locking blocks and the base section, respectively.

9 Claims, 4 Drawing Sheets

ELECTRICAL CONNECTOR WITH STEADY SHELL

BACKGROUND OF THE INVENTION

1. Field of the Invention

The present invention relates to an electrical connector, and more particularly to an electrical connector having a shell reliably rooted thereon.

2. Description of the Prior Art

U.S. Pat. No. 5,401,189 discloses an electrical connector comprising an insulative housing, a shell and a pair of locking blocks. The insulative housing has a base section and a mating port upwardly extending from the base section. The base section is formed with a pair of ears at opposite longitudinal ends thereof. The locking block is formed with a hook and a mounting base having a recess defined thereon to fitly retain corresponding ear of the base section. The mounting base further defines a hole beside the hook. The shell is formed with a frame section surrounding the mating port of the housing and a plate section attached on the base section. The plate section defines an aperture with corresponding hook of the locking block passing therethrough. The plate section further defines a pair of holes which are aligned with the holes of the mounting bases of the locking blocks, whereby a pair of locking through holes is formed by combining the holes of the plate sections and corresponding holes of the mounting bases.

However, the locking through holes generally are located at opposite longitudinal ends of the conventional electrical connector, whereby the dimension along the longitudinal direction of the conventional electrical connector increases. In some special applications, the conventional electrical connector in this configuration cannot meet with the requirement due to the longitudinal dimension thereof.

Hence, an improved electrical connector is desired to overcome the disadvantages of the prior art.

SUMMARY OF THE INVENTION

Accordingly, an object of the present invention is to provide an electrical connector, and particularly to an electrical connector having a reliably assembled shell with a simply configuration.

To achieve the above objects, an electrical connector includes an insulative housing having base section and a mating port forwardly projecting from the base section, a number of terminals loaded in the insulative housing and each having a contact section disposed in the mating port and a shell provided with a frame section surrounding the mating port and a plate section attached to the base section. The plate section is formed with a pair of ears at opposite longitudinal ends of the base section. The electrical connector further includes a pair of locking blocks disposed at opposite longitudinal ends of the base section. Each locking block is formed with a mounting section rooted onto the base section and a forwardly extending hook beside the mating port. The ears of the plate section are securely sandwiched between the mounting sections of the locking blocks and the base section, respectively.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Reference will now be made to the drawings to describe the present invention in detail.

Figure 1:
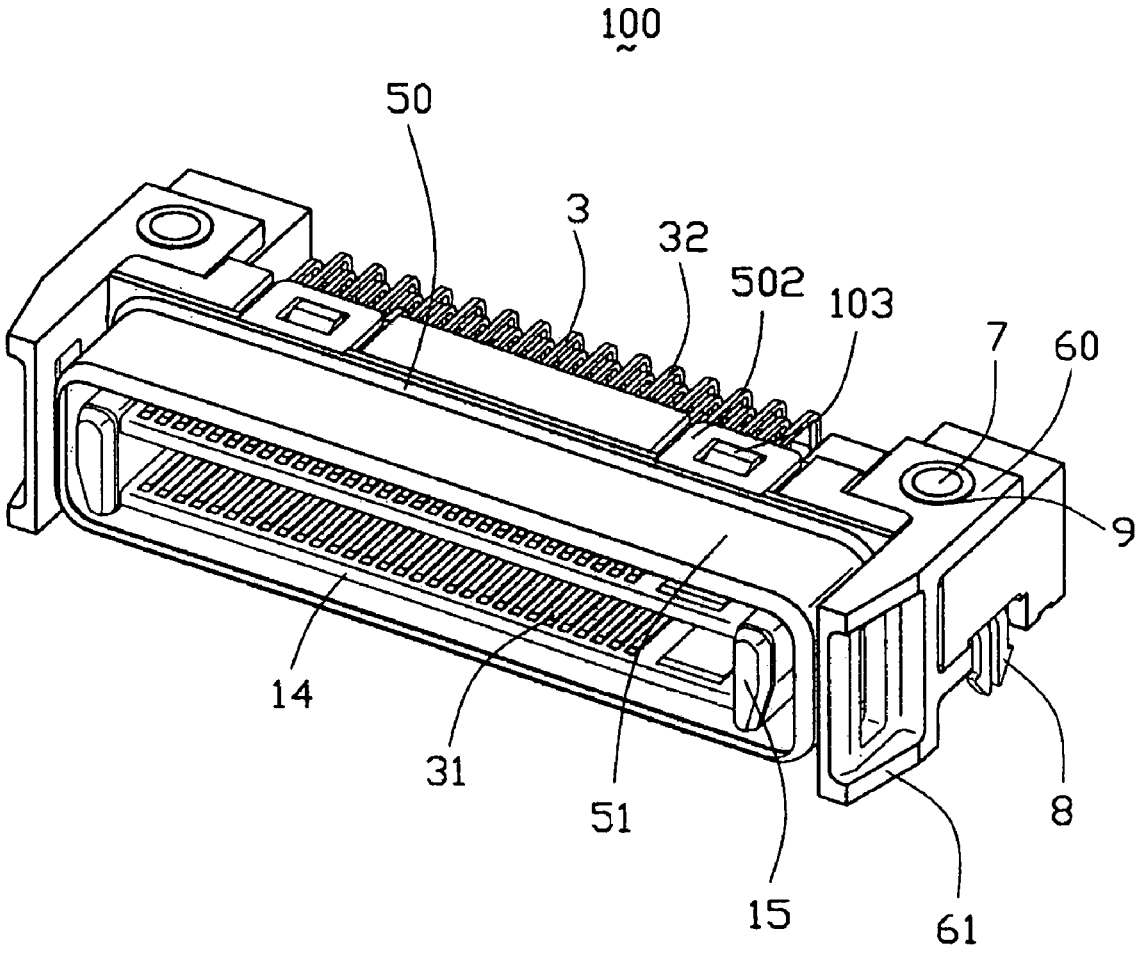
FIG. 1 is an assembled perspective view of an electrical connector in accordance with the present invention.

Referring to FIG. 1, an electrical connector 100 of the present invention is adapted for mounting onto a Print Circuit Board (PCB) (not shown) and serves as a docking of the PCB to electrically connect with a cable connector assembly (not shown) which serves as a sailer of a periphery equipments.

Figure 3:
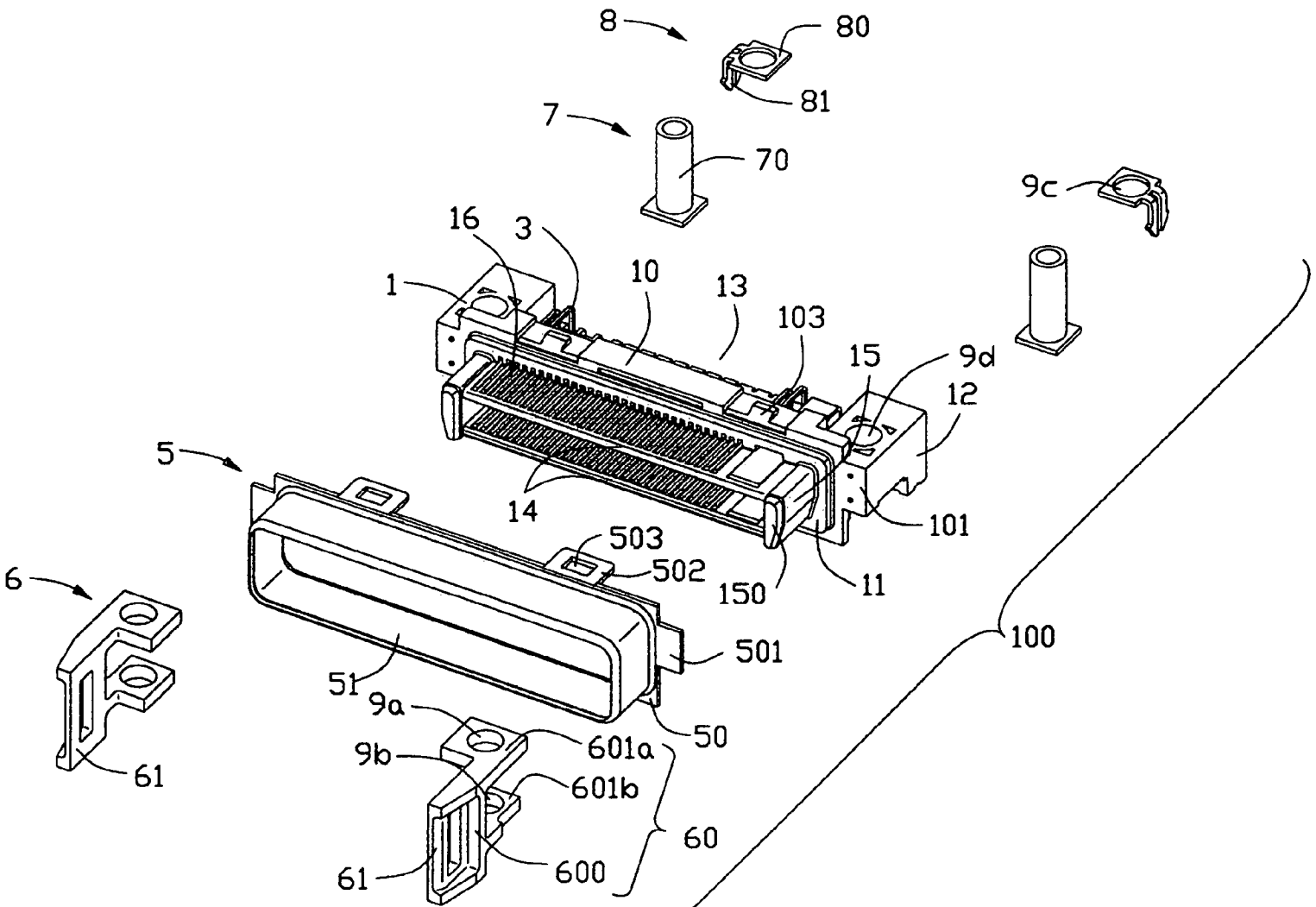
FIG. 3 is an exploded perspective view of the electrical connector shown in FIG. 1.
Figure 4:
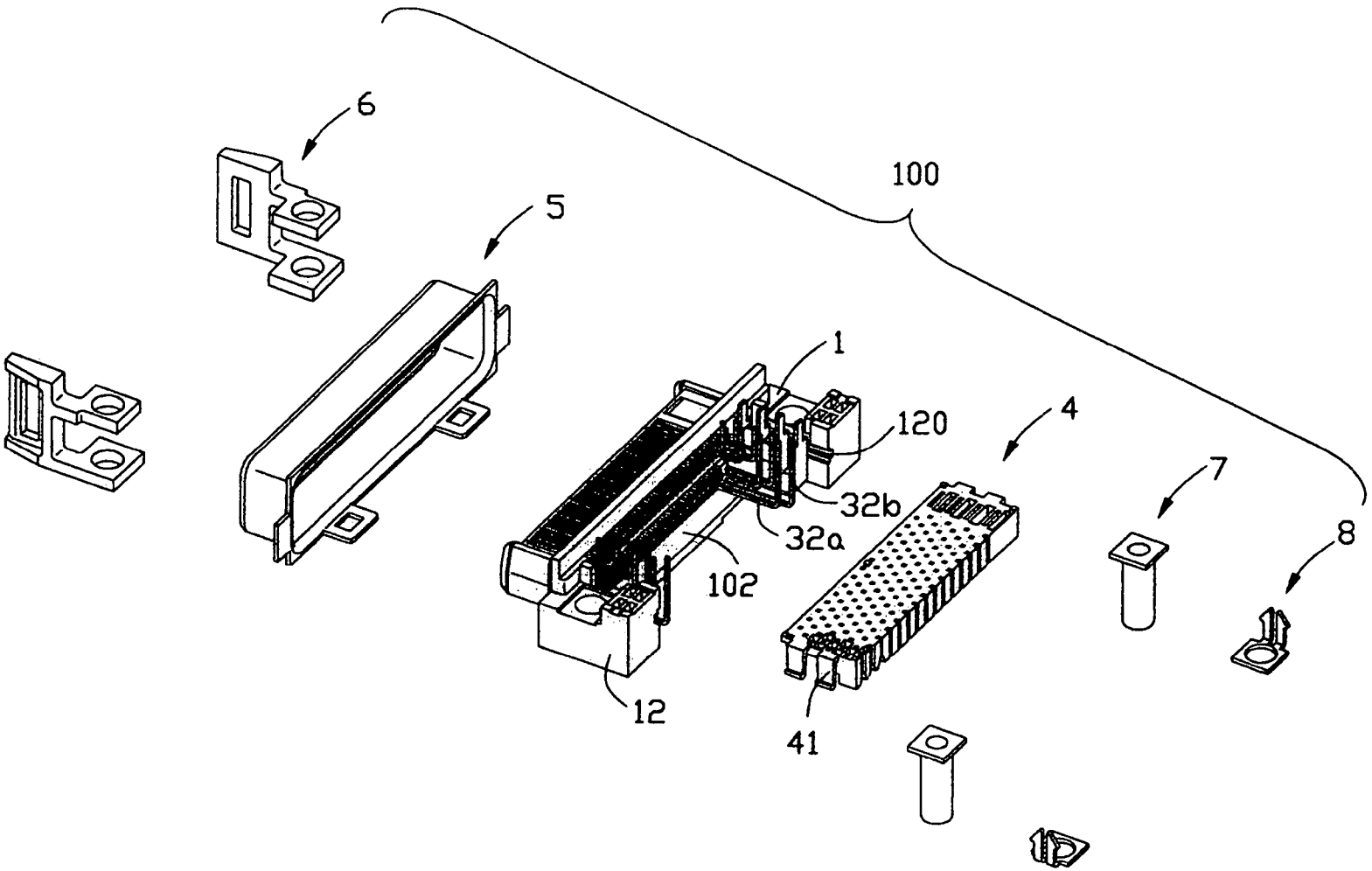
FIG. 4 is an exploded perspective view of the electrical connector shown in FIG. 2.

The electrical connector 100 comprises a unitarily molded insulative housing 1, as shown in FIGS. 3 and 4. The insulative housing 1 includes an elongated intermediated base section 10 having a front face 101 and an opposite rear face 102. A platform 11 is provided to appreciably protrude forwardly from the front face 101 of the base section 10 and a pair of legs 12 is provided to extend rearwardly from opposite ends of the rear face 102 of base section 10. A receiving space 13 is defined between the spaced legs 12 and the base section 10. The insulative housing 1 is further provided with a pair of parallel and spaced longitude mating tongues 14 extending forwardly from the platform 11. Generally, the mating tongue 14 is apt to be destroyed due to the thin configuration. Thus, the corresponding longitude ends of the mating tongues 14 are respectively interconnected by a pair of transverse ribs 15, whereby a steadily first mating frame is defined to engage with a mating port of the complementary cable connector assembly. Each transverse rib 15 is formed with a tip 150 extending beyond a mating face defined by the first mating frame for guiding purpose. Each transverse rib 15 is configured in dissymmetric cross-section shape, such as taper, for anti-mating with the complementary cable connector assembly.

Figure 2:
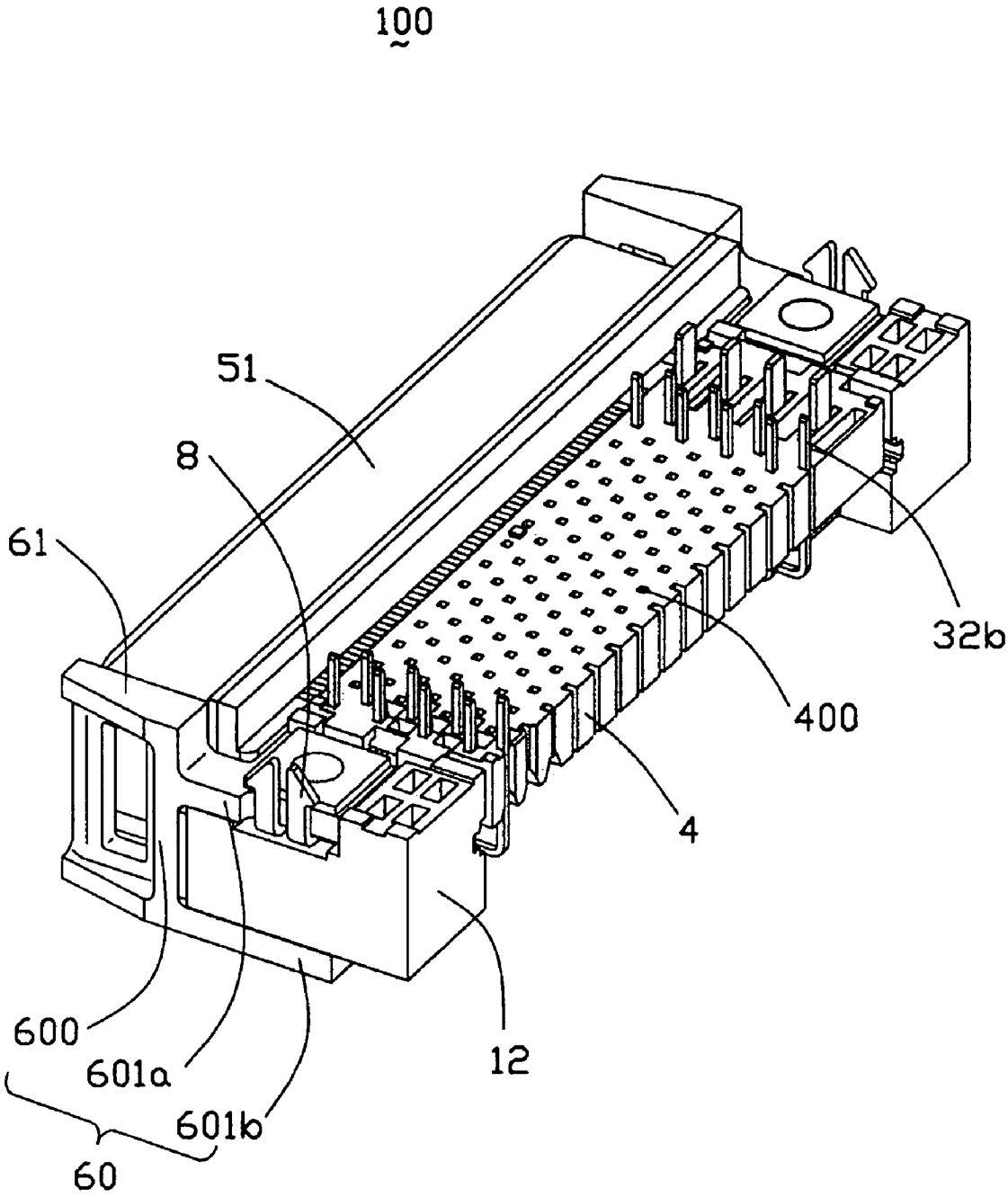
FIG. 2 is an assembled perspective view of the electrical connector shown in FIG. 1 taken from another aspect.

A plurality of passageways 16 is defined on opposite mating surfaces of each mating tongue 14 and pass through the base section 10 to communicate with the receiving space 13. Referring to FIG. 1, a plurality of terminals 3 is loaded into the corresponding passageways 16 and each is provided with a contacting section 31 exposed on a mating surface of the mating tongue 14 and a tail 32 extending into the receiving space 13. Each tail 32 has a parallel section 32*a* and a vertical tine 32*b* perpendicularly extending beyond a mounting face of the insulative housing 1 shown in FIG. 4. As best shown in FIGS. 2 and 4, a spacer 4 is accommodated in the receiving space 13 to align tips of the tines 32*b* of the terminals 3. The spacer 4 is formed with a pair of latches 41 at opposite end thereof to engage with corresponding recesses 120 defined in inner faces of the legs 12, whereby the spacer 4 is securely held between the opposite legs 12.

Referring to FIGS. 1 and 3, the electrical connector 100 further includes a shell 5 assembled to the insulative housing 1. The shell 5 is provided with a plate section 50 attached to the front face 101 of the base section 10 with a pair of ears 501 disposed at opposite longitude ends thereof. The plate section 50 is formed with a pair of flanges 502 extending rearwardly along an upper face of the base section 10. Each flange 502 define an aperture 503 locking with a corresponding protrusion 103 formed on the upper face of the base section 10 and cooperating with the ears 501 of plate section 50 for attaching the shell 5 to the insulative housing 1, as will be described hereafter. A frame section 51 projects from the plate section 50 with an inner edge of one end thereof adjacent to the plate section 50 fitly enclosing an periphery edge of the platform 11 and an free end thereof serving as a second mating frame section. The second mating frame section surrounds the first mating frame to define an annular recess therebetween for receiving corresponding portion of the complementary cable connector assembly.

The electrical connector 100 further includes a pair of locking blocks 6, and a pair of board lock 8 provided with a mounting ring 80 thereon. The locking blocks 6 is molded from metal material and the board lock 8 is stamped and formed from a metal sheet. Each locking block 6 is provided with a mounting section 60 adapted for being mounted onto the leg 12 and a hook 61 extending forwardly from the mounting section 60 for latching with the complement cable connector assembly. The mounting section 60 is formed with upper and lower spaced mounting arms 601*a*, 601*b* rearwardly extending from opposite ends of an interim section 600 of the mounting section 60 to define a space therebetween. The locking block 6 is assembled onto corresponding leg 12 together with the board lock 8.

Referring to FIGS. 1 and 2, in assembled state, a front end of the leg 12 and the mounting ring 80 provided on the board lock 8 are both retained in the space between the upper and lower mounting arms 601*a*, 601*b* with the upper mounting arm 601*a* abutting against an upper face of the leg 12 and the lower mounting arm 601*b* abutting against the mounting ring 80 provided on the board lock 8. Simultaneously, the ear 501 provided on the plate section 50 of the shell 5 is tightly sandwiched between the interim 620 of the mounting section 60 and the front face 101 of the base section 10, whereby the shell 5 is securely assembled onto the insulative housing 1. The board lock 8 is formed with a locking foot 81 extending beyond the mounting face of the insulative housing 1 for being fitted into a hole defined in the PCB. The shell 5 is combined with the locking block 6 and the board lock 8 to establish an integrated shielding system for protecting EMI.

A locking through hole 9 is formed by aligning holes 9*a*, 9*b* defined on the mounting arms 601*a*, 601*b*, a hole 9*c* defined on the mounting ring 80 and a hole 9*d* defined on the leg 12 of the housing 1 in assembled state. A fastener 7 is provided to be received in the locking through hole 9 by passing through the upper arm 601*a*, the leg 12, the ring 80 of the board lock 8 and the lower arm 601*b* in turn. The fastener 7 has a hollow post 70 passing through the locking through hole 9. The engagement is achieved by expanding a free end of the hollow post 70, thereby the locking block 6 and the board lock 8 is securely assembled onto the insulative housing 1.

While a preferred embodiment in accordance with the present invention has been shown and described, equivalent modifications and changes known to persons skilled in the art according to the spirit of the present invention are considered within the scope of the present invention as defined in the appended claims.

What is claimed is:

1. An electrical connector, comprising:

an insulative housing comprising a base section and a mating port forwardly projecting from the base section;

a plurality of terminals loaded in the insulative housing and each having a contact section disposed in the mating port;

a shell provided with a frame section surrounding the mating port and a plate section attached to the base section, the plate section formed with a pair of ears attached at opposite longitudinal ends of the base section; and a pair of locking blocks disposed at the opposite longitudinal ends of the base section and each formed with a mounting section mounted onto the base section and a forwardly extending hook beside the mating port;

a pair of fasteners to fasten the locking blacks and the base section together by passing through the mounting section of the locking blocks and the base section in a vertical direction perpendicular to the longitudinal and mating directions; wherein the ears of the plate section are securely sandwiched between the locking blocks and the base section, respectively.

2. The electrical connector as claimed in claim 1, wherein the plate section is formed with a flange attached on an upper surface of the base section of the insulative housing.

3. The electrical connector as claimed in claim 1, further comprising a pair of board lock disposed at the opposite longitudinal ends of the base section and each having a mounting ring mounted onto the base section and a locking foot.

4. The electrical connector as claimed in claim 3, wherein the mounting section of the locking block includes a pair of spaced mounting arms, and wherein the longitudinal ends of the base section together with the mounting ring of the board lock is sandwiched between the mounting arms.

5. The electrical connector as claimed in claim 4, wherein the shell as well as the locking blocks and the board locks is made of metallic material, and wherein the shell is electrically connecting with the locking blocks and the locking blocks is electrically connecting with the board locks.

6. The electrical connector as claimed in claim 4, the fastener passes trough the mounting ring of the board lock.

7. An electrical connector, comprising:

an insulative housing comprising a base section and a mating port forwardly projecting from the base section;

a plurality of terminals loaded in the insulative housing and each having a contact section extending into the mating port;

a shell provided wit a frame section surrounding the mating port and a plate section attached to the base section, the plate section formed with a pair of ears attached at opposite longitudinal ends of the base section; and a pair of locking blocks disposed at the opposite longitudinal ends of the base section and each formed with a mounting section mounted onto the base section and a forwardly extending hook extending beside the mating port; wherein the forwardly extending hook is located substantially outside the mounting section along the longitudinal direction, and the ears of the plate section are securely sandwiched between the locking blocks and the base section, respectively.

8. The electrical connector as claimed in claim 7, wherein said mounting section defines a securement hole extending in a vertical direction perpendicular to a mating direction.

9. The electrical connector as claimed in claim 8, further including a board lock which has an attachment hole in alignment with said securement hole in said vertical direction.

* * * * *